US006168426B1

(12) United States Patent
Yamada

(10) Patent No.: US 6,168,426 B1
(45) Date of Patent: Jan. 2, 2001

(54) BATCH-TYPE KILN

(75) Inventor: Yoshitsugu Yamada, Omihachiman (JP)

(73) Assignee: Murata Manufacturing Co., Ltd., Nagaokyo (JP)

( * ) Notice: Under 35 U.S.C. 154(b), the term of this patent shall be extended for 0 days.

(21) Appl. No.: 08/800,068

(22) Filed: Feb. 14, 1997

(30) Foreign Application Priority Data

Feb. 19, 1996 (JP) ..... 8-056944

(51) Int. Cl.[7] ..... F27B 9/04

(52) U.S. Cl. ..... 432/152; 432/241; 432/206; 432/209; 219/390; 392/416

(58) Field of Search ..... 432/206, 205, 432/209, 241, 152, 171; 219/390, 405, 411; 392/416, 418

(56) References Cited

U.S. PATENT DOCUMENTS 3,540,710 * 11/1970 Yamagishi ..... 432/206
4,147,506 * 4/1979 Southern et al. ..... 432/206
4,673,799 * 6/1987 Mahawili ..... 118/724
4,701,739 * 10/1987 Sasaki ..... 338/34
4,725,711 * 2/1988 Minegishi et al. ..... 219/270
5,207,573 * 5/1993 Miyagi et al. ..... 432/206
5,221,201 * 6/1993 Yamaga et al. ..... 432/241
5,239,614 * 8/1993 Ueno et al. ..... 392/416
5,329,095 * 7/1994 Okase ..... 219/390
5,383,984 * 1/1995 Shimada et al. ..... 156/345
5,480,300 * 1/1996 Okoshi et al. ..... 432/205
5,556,018 * 9/1996 Kanehira ..... 225/2

* cited by examiner

*Primary Examiner*—Stephen Gravini
*Assistant Examiner*—Jiping Lu
(74) *Attorney, Agent, or Firm*—Burns, Doane, Swecker & Mathis, LLP

(57) ABSTRACT

A novel batch-type kiln and a method of use thereof are provided. The kiln comprises a kiln body and a heating chamber disposed within the kiln body, which has a heater disposed therein. A table is disposed at the bottom of the heating chamber, the table having a peripheral portion and an upper surface for supporting an object to be treated. The peripheral portion of the table and a portion of the kiln body define a gap therebetween. This gap forms a gas-introducing path for introducing a gas into the heating chamber. The batch-type kiln is capable of preventing accumulation of a binder component in the gap between the table and the kiln wall.

8 Claims, 3 Drawing Sheets

BATCH-TYPE KILN

This application is based on Japanese Priority Application Hei 8-56944, the contents of which are hereby incorporated by reference.

BACKGROUND OF THE INVENTION

1. Field of the Invention

The present invention relates a batch-type kiln having particular applicability in the performance of firing treatments, such as a dewaxing step and a firing step, on a ceramic product, such as a ceramic capacitor.

2. Description of the Related Art

Conventional batch-type kilns comprise a heating chamber and a table. The heating chamber is formed by placing a rod-shaped or U-shaped heater within a box-shaped or cylindrical kiln body. A table is disposed at the bottom portion of the heating chamber and is capable of being raised and lowered. A sagger containing a ceramic product is placed on the table, and the table is raised to place the sagger into the heating chamber for firing treatment. Upon completion of the treatment, the table is lowered and the sagger is removed from the kiln.

Conventionally, dewaxing and firing steps are successively performed on the ceramic product. However, in so treating the ceramic product in conventional batch-type kilns, the treatment of an organic binder produced during dewaxing becomes a problem. Decomposition of the binder produces a gas which is heavier than air. This gas flows downward towards the bottom of the heating chamber. There is a narrow gap between an outer peripheral portion of the table and the kiln body, the temperature of the gap being less than 100° C. during firing. As a result of this relatively low temperature in the gap, the gas produced from binder decomposition which flows therethrough liquefies or solidifies, accumulating as tar which produces an offensive smell. In addition, the kiln wall and the table are made of a felt-like heat-insulating material. The gas produced by binder decomposition penetrates into this heat-insulating material, causing the penetrated binder component to carburize due to thermal decomposition or the like. This effect can result in reduced heat insulation, electrical leakage, or other problems.

SUMMARY OF THE INVENTION

Accordingly, an object of the present invention is to provide a batch-type kiln which can prevent accumulation of a binder component in, for example, a gap formed between a table and a kiln wall.

According to one aspect of the invention, there is provided a batch-type kiln. The kiln comprises a kiln body and a heating chamber disposed within the kiln body, which has a heater disposed therein. A table is disposed at the bottom of the heating chamber, the table having a peripheral portion and an upper surface for supporting an object to be treated. The peripheral portion of the table and a portion of the kiln body define a gap therebetween. This gap forms a gas-introducing path for introducing a gas into the heating chamber.

According to a second aspect of the invention, there is provided a batch-type kiln, which comprises a kiln body and a heating chamber disposed within the kiln body, the chamber having a heater disposed therein. A table is disposed at the bottom of the heating chamber for placing thereon an object to be fired. The table is capable of being raised and lowered. A gas-introducing path is also provided, for introducing into the heating chamber a gas which is the same type as an atmospheric gas in the kiln from a gap between an outer peripheral portion of the table and the kiln body.

The gas produced in the heating chamber by binder decomposition flows downward, attempting to flow into the gap between the table and the kiln body. However, by supplying the same type of gas as the atmospheric gas in the kiln through the gap and into the heating chamber prevents the gas formed by binder decomposition from flowing into the gap, thus preventing accumulation of the binder component in the gap. In addition, the gas produced by binder decomposition in the vicinity of the kiln body becomes agitated due to the inflowing gas, thereby reducing binder component adhesion onto and penetration into the kiln body and the table.

The gas supplied into the heating chamber is the same type as the atmospheric gas in the kiln, so that the atmosphere in the kiln will not be disturbed. In the batch-type kiln in which a degreasing step and a firing step are successively performed, the aforementioned gas is introduced only during the dewaxing step, such that the gas is not supplied during the firing step.

In the above-described kiln, it is preferable to supply a gas which is of the same type as the atmospheric gas, along the horizontal face of a step (formed at the outer peripheral portion of the table) from the outer periphery inwardly, and then to allow the gas to flow upwardly along the vertical face of the step and into the heating chamber. In such a case, the gas-supplying path is non-linear, which reduces the amount of heat escaping from the heating chamber, and allows heat to be left in the gas flowing through this path. As a result, a temperature drop in the kiln occurs less often.

When the outer periphery of the heater is covered with a thermal resistant insulating tube, it is fully protected from the binder component produced during the dewaxing step, thereby eliminating the problem of electrical leakage occurring between heaters or between a heater and the kiln body. In addition, in such a case, effects on the properties of the object to be fired due to evaporation of impurities contained in the heater are reduced. Further, effects on the heater due to evaporation of impurities contained in the object to be fired are reduced.

It is preferable to form a cylindrical air chamber at an outside wall of the kiln, and provide the chamber with an opening for admitting air into the air chamber and an opening for discharging air therefrom. In such a case, when the temperature rises in the kiln, the air chamber is used as a heat-insulating layer. During the cooling process, the accumulated heat in the air layer is removed by allowing the air to circulate via the air admission opening and the air discharge opening, thereby removing the accumulated heat in the air layer for effective cooling.

BRIEF DESCRIPTION OF THE DRAWINGS

The objects and advantages of the invention will become apparent from the following detailed description of the preferred embodiments thereof in connection with the accompanying drawings in which like numerals designate like elements, and in which.

DESCRIPTION OF THE PREFERRED EMBODIMENTS OF THE INVENTION

Figure 1:
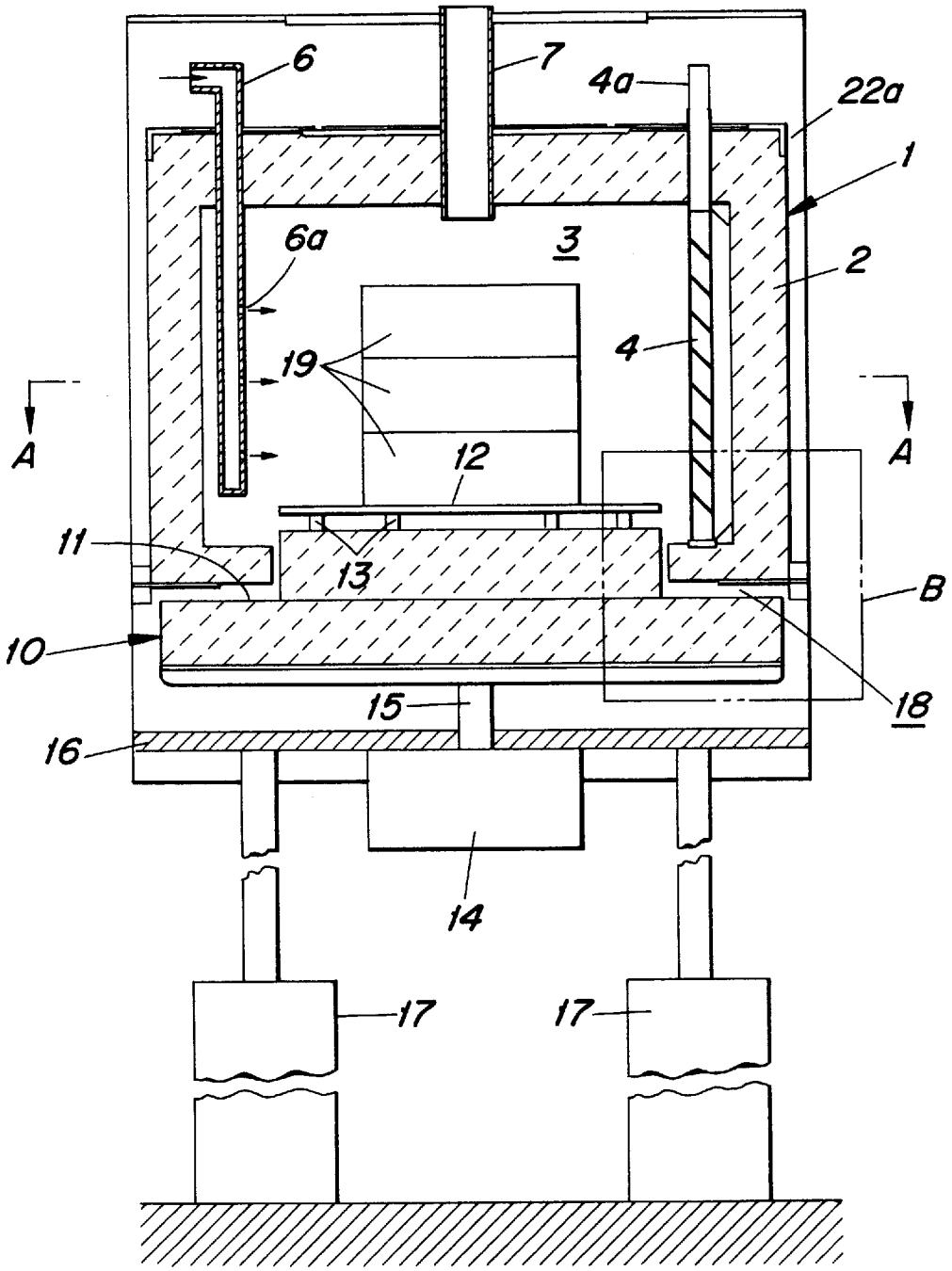
FIG. 1 is a sectional view of a batch-type kiln in accordance with the present invention.
Figure 2:
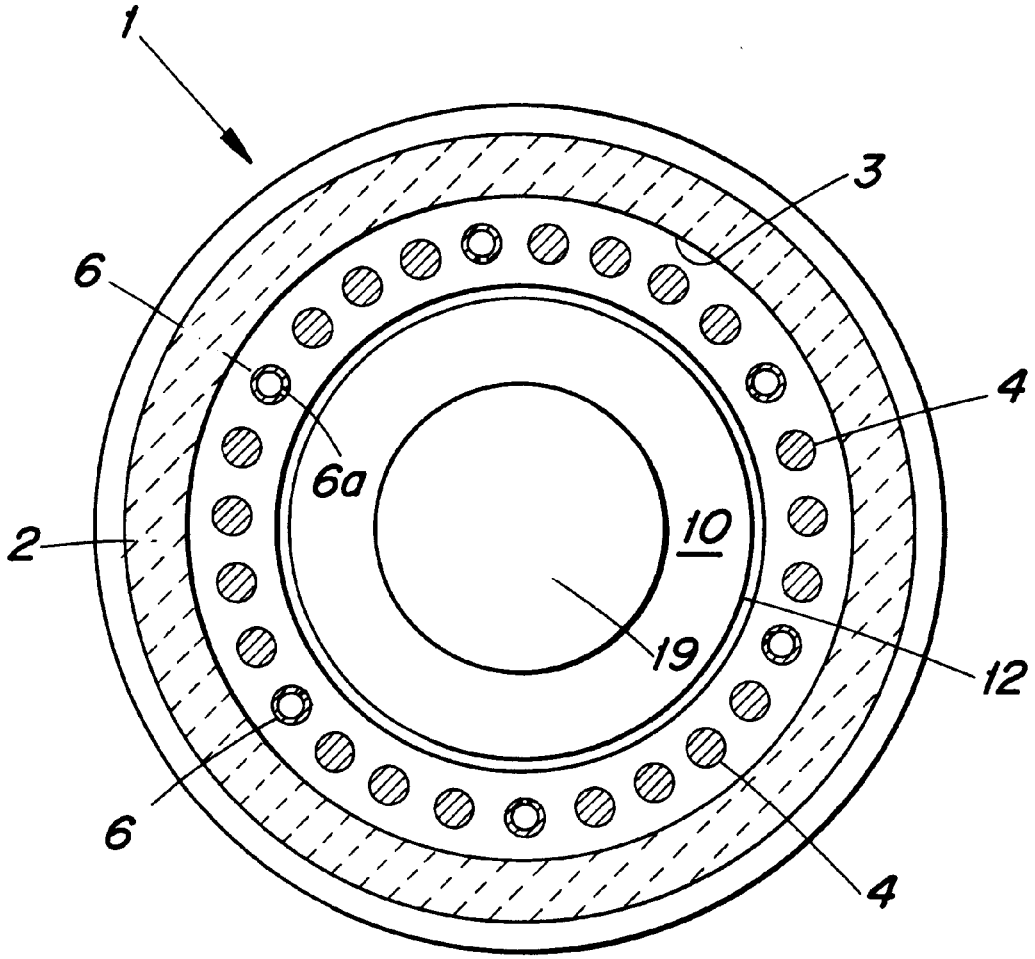
FIG. 2 is a sectional view taken along line A—A of the batch-type kiln of FIG. 1.
Figure 3:
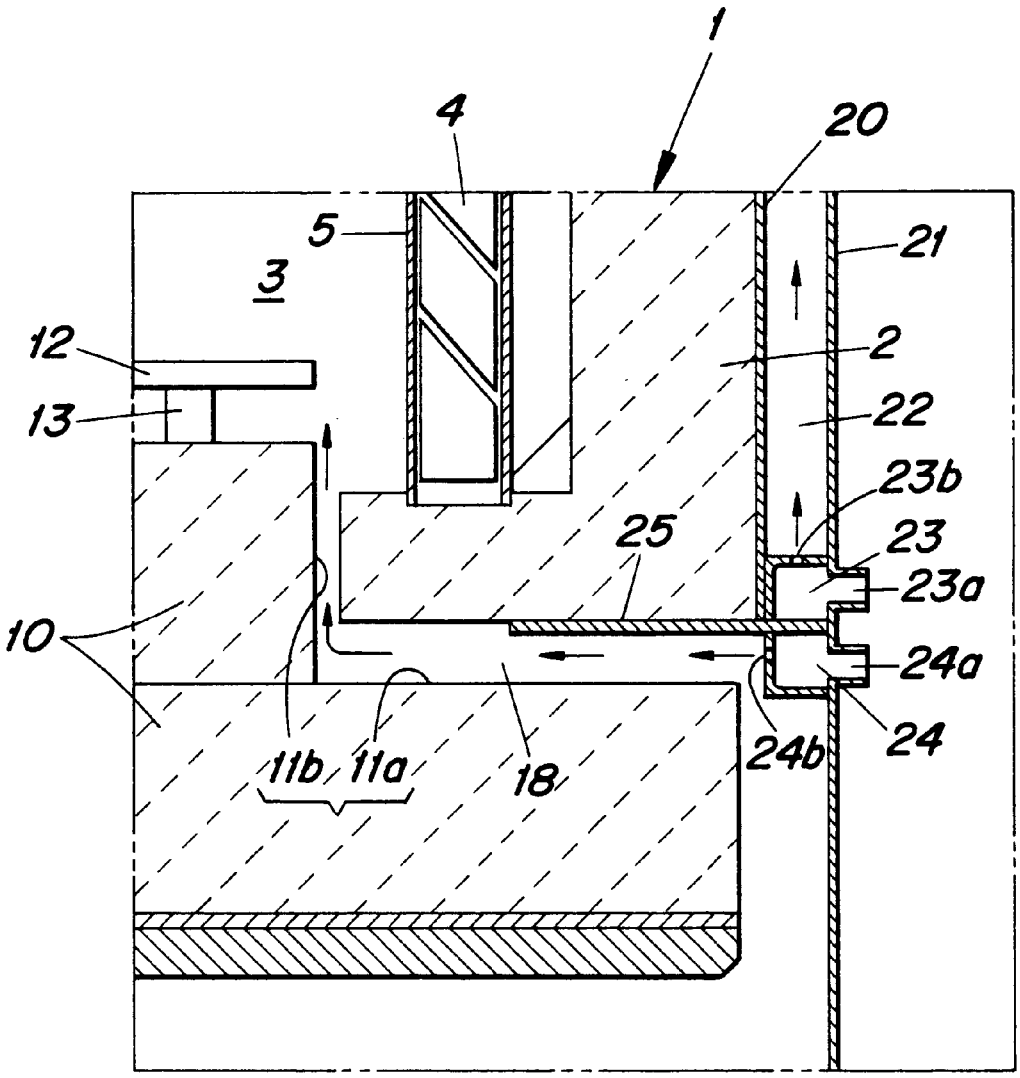
FIG. 3 is an enlarged view of section B of the batch-type kiln of FIG. 1.

With reference to FIGS. 1 to 3, one embodiment of a batch-type kiln in accordance with the present invention will be described.

The batch-type kiln comprises a cylindrical kiln body 1 having an opening at the bottom portion thereof and formed by a heat-resistant member 2 made of, for example, ceramic brick or felt. The kiln further includes a heating chamber 3, which has a plurality of spiral heaters 4 disposed in a concentric manner with heating chamber 3. Spiral heaters 4 pass through the ceiling of kiln body 1, and are inserted into heating chamber 3 through the upper wall of chamber 3.

Spiral heaters 4 are covered along their respective outer peripheries with a heat-resistant insulating tube 5, except for a terminal portion 4*a* of the heaters. Tube 5 can be constructed of a material which does not allow penetration of a binder component or the like, such as fine alumina or silica ceramic. The bottom end opening of tube 5 butts against the bottom portion of kiln body 1. In this way, the gas produced in heating chamber 3 by binder decomposition is prevented from flowing into tube 5.

Gas supply tubes 6 are disposed in the same concentric pattern formed by spiral heaters 4. Like spiral heaters 4, gas supply tubes 6 are inserted into heating chamber 3 through the ceiling of kiln body 1. From a gas supply source (not shown), an atmospheric gas which is suitable for use in the dewaxing step and the firing step, i.e., air or any of its components (e.g., $N_2$, $H_2$ and $H_2O$), is supplied to gas supply tubes 6 in order to introduce the atmospheric gas towards the center of heating chamber 3 through blowing openings 6*a*.

An exhaust tube 7 is provided at an upper portion of kiln body 1 in order to exhaust gas from heating chamber 3. As shown in FIG. 1, exhaust tube 7 is preferably disposed along the central axis of heating chamber 3. Exhaust tube 7 is connected to an exhaust gas treating device (not shown).

A table 10 with a step portion 11 formed at an outer periphery thereof is disposed at the bottom portion of heating chamber 3. Table 10 is made of a heat-resistant material such as described with reference to kiln body 1. A ceramic plate 12 is horizontally supported by means of plural columns 13, so as to be raised from the upper surface of table 10. Plate 12 is used to hold one or more saggers 19 each containing an object to be fired. Such an object can include, for example, a molded part formed from a ceramic.

In order to uniformly fire the object by means of heaters 4 disposed around the object and to allow the objects being fired to equally contact the atmospheric gas, table 10 is rotated. In this regard, a rotary shaft 15 of a motor 14 is linked to the lower central portion of table 10. A plate 16 mounted to motor 14 can be driven vertically upward or downward by means of a raising-and-lowering device 17, such as a hydraulic cylinder. Thus, table 10 can be rotationally driven by motor 14, and can be vertically driven upward and downward by raising-and-lowering device 17.

Step portion 11, formed at the outer periphery of table 10, is formed by a horizontal face 11*a* and a vertical face 11*b*. Faces 11*a* and 11*b* are disposed in the vicinity of heating chamber 3. A gas-introducing path 18 (FIG. 3) is formed by the gap between step portion 11 and a portion of kiln body 1.

A metallic inner frame 20 is placed on the outer peripheral face of kiln body 1, and an outer frame 21 is placed over inner frame 20 such that at the outer peripheral portion, inner frame 20 is spaced at an equal interval, for example, from 20 to 30 cm, from outer frame 21. A cylindrical air chamber 22 is formed in this space between inner frame 20 and outer frame 21.

A discharge opening 22*a* facing an upper portion of the kiln is formed at the upper portion of air chamber 22, while an annular air supply portion 23 is formed at a lower portion of air chamber 22. From an air supply source (not shown), air is supplied to supply portion 23 via an air admission opening 23*a*. The air is supplied into air chamber 22 from a plurality of blowout openings 23*b* formed at constant pitches in the upper wall of supply portion 23. In this way, the air in air chamber 22 flows upward and is discharged from discharge opening 22*a*.

An annular gas-introducing portion 24 is formed at a point below annular air supply portion 23. Air supply portion 23 and gas-introducing portion 24 are separated by a dividing plate 25, which also serves as a supporting plate for supporting the bottom surface of kiln body 1. A gas, which is of the same type as that supplied to gas supply tube 6, is supplied to gas-introducing portion 24 through a gas admission opening 24*a*. The gas is then blown radially inwardly from a plurality of blowout openings 24*b* formed at constant pitches along an inner wall of gas-introducing portion 24. The gas passes through gas-introducing path 18 and into heating chamber 3. More specifically, as shown in FIG. 3, the gas flows radially inward along the horizontal face 11*a* of step portion 11 of table 10, and then flows upwardly along vertical face 11*b* of step portion 11. In this manner, the gas is flows upwardly, concentrically, and uniformly into heating chamber 3.

The operation of the kiln having the above-described construction is discussed below.

Table 10 is lowered by raising-and-lowering device 17 to allow the placement of a plurality of boxes 19 on top of each other on table 10. Table 10 is next raised to introduce boxes 19 into heating chamber 3.

Table 10 is rotated by motor 14, and power is supplied to heaters 4 in order to heat the heating chamber 3 to a predetermined temperature. Atmospheric gas is supplied from gas supply tubes 6 to heating chamber 3 to perform a dewaxing step. In the dewaxing step, an organic binder gas formed by decomposition is produced from parts molded from ceramic (i.e., the objects to be fired). This gas attempts to accumulate at the bottom portion of heating chamber 3 due to its relatively heavy weight. The introduction of a gas which is the same type as the atmospheric gas through gas-introducing portion 24 into heating chamber 3 via gas-introducing path 18 causes it to be uniformly blown out from the gap between kiln body 1 and table 10, thereby preventing the gas produced by binder decomposition from flowing into the gap.

The gas also generates a current in the vicinity of the wall of kiln body 1 and the region around table 10, thereby reducing penetration of the gas produced by binder decomposition into the heat-resistant materials forming kiln body 1 and table 10. The exhaust gas created in the heating chamber is exhausted through exhaust tube 7 at the top portion of the kiln.

The dewaxing step is followed by a firing step. More specifically, the supply of atmospheric gas from gas supply tube 6 and from gas-introducing path 18 is stopped, and the temperature of heaters 4 is raised to fire the object being treated. Here, although the binder component, remaining in heating chamber 3, is completely decomposed by heat, there is a smaller amount of binder component in the gap between table 10 and kiln body 1, and a smaller amount adhering to the wall of kiln body 1, thereby preventing deterioration of the heat-resistant members and reducing the amount of dirt on kiln body 1.

As described above, air chamber 22 is formed at the outer peripheral portion of kiln body 1. As the temperature rises, air supply to air chamber 22 is stopped, thus allowing air chamber 22 to be used as a type of heat-resistant layer. Therefore, heat-resistant member 2 can be made thinner than previously possible, reducing the size of kiln body 1.

During the cooling process, air is supplied from blowout openings 23*b* of air supply portion 23 into air chamber 22, and is discharged from discharge opening 22*a*. The accumulated heat in air chamber 22 is thereby removed at one time. As a result, the cooling time of kiln body 1 is reduced.

The present invention is not limited to the above-described embodiment. For example, the kiln body of the present invention can be a shape other than cylindrical.

Furthermore, while the table has been described as a rotating table, the table can be one which only moves in the vertical direction. Therefore, the table is not limited to one which is disc-shaped. For example, the table can be cylindrical in shape, in addition to one having a step portion formed at the outer peripheral portion of the table. In such a case, the gas supply path can extend linearly upward.

Although in the foregoing description, the atmospheric gas supply tube and the gas-introducing path were described as being separate from one another, the supply tube can be eliminated. In this case, the gas supply path can be used in place of the supply tube. In such a case, however, it is still necessary to provide a gas supply tube for supplying atmospheric gas into the boxes, since the gas-introducing path causes a gas current to be generated on the table. Therefore, when the gas-introducing path is used as a substitute for the gas supply tube, it is preferable that the object to be fired not be contained in a sagger.

In addition, although the exhaust tube for removing exhaust gas has been described as being disposed at the top portion of the heating chamber, it can optionally be disposed at the side portion thereof.

Furthermore, although the heaters have been described as being arranged concentrically and vertically with respect to the kiln body, they can be arranged horizontally, in the case where the kiln body is square in shape.

The heaters themselves can be rod-shaped or U-shaped, in addition to being spiral-shaped. However, rod-shaped heaters should have terminal portions at both ends thereof. In the case of U-shaped heaters, an elliptical section should be present when covered with a heat-resistant insulating tube. For spiral heaters, the terminal portions are at one side and are rod-shaped, thereby allowing the use of a cylindrical tube. Thus, the arrangement becomes simple, and costs are reduced.

It is preferable that the heat-resistant insulating tube be made of a material, such as alumina or silica ceramic, which does not allow penetration of a binder component, is fine, and is not conductive.

As can be understood from the foregoing description, a gas-introducing path is provided in order to introduce a gas which is of the same type as the atmospheric gas in the kiln from the gap between the outer peripheral portion of the table and the kiln body. The gas blown out from the gas-introducing path prevents the flow of a binder gas produced by decomposition into the gap between the table and the kiln body, whereby accumulation of the binder component in the gap is prevented from occurring. In addition, the gas produced by binder decomposition at the vicinity of the wall of the heating chamber is agitated due to the inflowing gas, thereby reducing the amount of binder component adhesion onto and penetration into the table and the heat-resistant member forming the kiln body.

What is claimed is:

1. A batch-type kiln, comprising:

a kiln body;

a heating chamber disposed within the kiln body, the heating chamber and the kiln body being cylindrical in shape;

a plurality of heaters disposed in the heating chamber, the heaters being arranged concentrically with respect to the heating chamber;

a plurality of gas supply tubes for introducing a gas into the heating chamber, the plurality of gas supply tubes and the plurality of heaters together forming the same concentric circle with respect to the heating chamber; and a table disposed at the bottom of the heating chamber, the table having a peripheral portion and an upper surface for supporting an object to be treated, the peripheral portion of the table and a portion of the kiln body defining a gap therebetween, the gap forming a gas-introducing path for introducing a gas into the heating chamber.

2. The batch-type kiln according to claim 1, wherein the plurality of gas supply tubes each has plural blow openings facing the central axis of the heating chamber.

3. The batch-type kiln according to claim 2, further comprising an exhaust tube extending through an upper wall of the kiln body along a central axis thereof, for exhausting gas from the heating chamber.

4. A batch-type kiln, comprising:

(a) a kiln body cylindrical in shape;

(b) a cylindrical heating chamber disposed within the kiln body and concentric thereto;

(c) a plurality of heaters disposed within and concentric to the heating chamber;

(d) a plurality of gas supply tubes for introducing a gas into the heating chamber, the plurality of gas supply tubes and the plurality of heaters together forming the same concentric circle with respect to the heating chamber;

(e) an exhaust tube extending through an upper wall of the kiln body along a central axis thereof, for exhausting gas from the heating chamber.

(f) a table disposed at the bottom of the heating chamber, the table having a peripheral portion and an upper surface for supporting an object to be treated, the peripheral portion of the table and a portion of the kiln body defining a gap therebetween, the gap forming a gas-introducing path for introducing a gas into the heating chamber;

(g) an annular gas supply inlet in communication with the gas-introducing path for introducing a gas therethrough; and (h) means for raising and lowering the table.

5. A method of using a batch-type kiln, the batch-type kiln comprising a kiln body; a heating chamber disposed within the kiln body, the heating chamber having a heater disposed therein; and a table disposed at the bottom of the heating chamber, the table having a peripheral portion and an upper surface for supporting an object to be treated, the peripheral portion of the table and a portion of the kiln body defining a gap therebetween, the gap forming a gas-introducing path for introducing a gas into the heating chamber, wherein the gap comprises a horizontal component and a vertical component continuous with each other, the method comprising:

(a) introducing an object into the heating chamber; and (b) performing a dewaxing process on the object by heating the heating chamber and by supplying an atmospheric gas through the gas-introducing path.

6. The method according to claim 5, further comprising rotating the object during the dewaxing process.

7. The method according to claim 5, further comprising performing a firing process on the object after the dewaxing process, wherein the atmospheric gas supplied through the gas-introducing path is stopped, and the temperature of the heater is increased.

8. The method according to claim 5, further comprising providing an air chamber circumscribing the kiln body, the air chamber having an annular air supply portion, wherein air is introduced into the air chamber through the air supply portion when the temperature of the heater is decreased, and wherein airflow into the air chamber through the air supply portion is stopped when the temperature of the heater is increased.

* * * * *